United States Patent [19]

Morganroth

[11] 4,108,184

[45] Aug. 22, 1978

[54] CLAMP DEVICES FOR USE IN SELECTIVELY ALTERING HAIR COLOR

[76] Inventor: Shila Morganroth, 1225 Waterbury Rd., Highland, Mich. 48031

[21] Appl. No.: 738,910

[22] Filed: Nov. 4, 1976

Related U.S. Application Data

[60] Division of Ser. No. 592,764, Jul. 2, 1975, which is a continuation-in-part of Ser. No. 481,695, Jun. 25, 1974.

[51] Int. Cl.[2] ..... A45D 8/00

[52] U.S. Cl. ..... 132/46 R

[58] Field of Search ..... 132/46, 48, 9, 139; 128/321, 337, 346; 24/259 HC

[56] References Cited

U.S. PATENT DOCUMENTS

| | | | |
|---|---|---|---|
| 1,516,661 | 11/1924 | Bechtold | 132/48 R |
| 3,247,852 | 4/1966 | Schneider | 128/346 |
| 3,304,945 | 2/1967 | Anderson | 132/9 |
| 3,417,761 | 12/1968 | Kulnis et al. | 132/46 R |

*Primary Examiner*—Louis G. Mancene
*Assistant Examiner*—Gregory E. McNeil
*Attorney, Agent, or Firm*—George H. Mortimer

[57] ABSTRACT

Clamp devices for use in selectively altering hair color-color, especially advantageous for use with off-the-scalp type bleach materials, comprising two bars hinged at one end to each other with a latch at the other end for removably holding them in the closed position with one face of one bar tightly against the opposed face of the other bar. The adjacent faces of each are aligned so that they may be placed close to the scalp with tresses of hair between the opposed faces, one of which may have spaced recesses for the tresses. A shield, e.g., a sheet of plastic, preferably is secured along one edge to one of the bars which extends away from said aligned edges far enough to underlie the tresses held in the clamp and protect the underlying bar from hair color altering liquids applied to the clamped tresses. For maintenance treatments where hair color altering materials should be applied to new growth only, a second clamp may be provided to be applied to the clamped tresses at the end of the new growth and it may have any desired structure, e.g., a hollow bar with an elastic band secured at one end to one end of the hollow bar and the other end removably securable to the other end of the hollow bar.

5 Claims, 4 Drawing Figures

FIG. 1
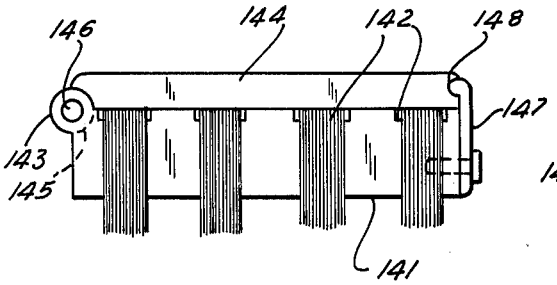
FIG. 2
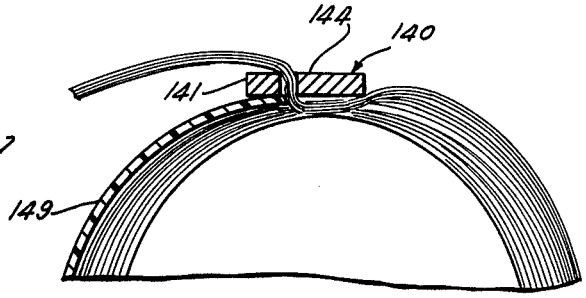
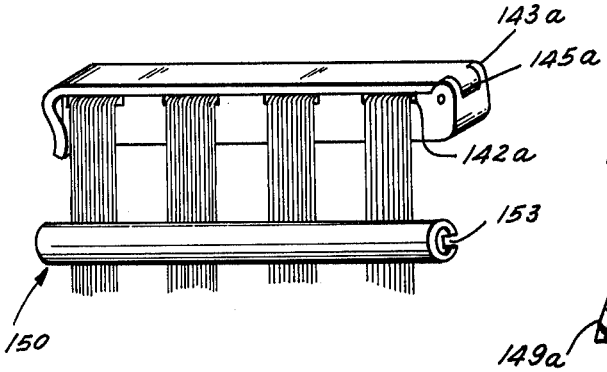
FIG. 3
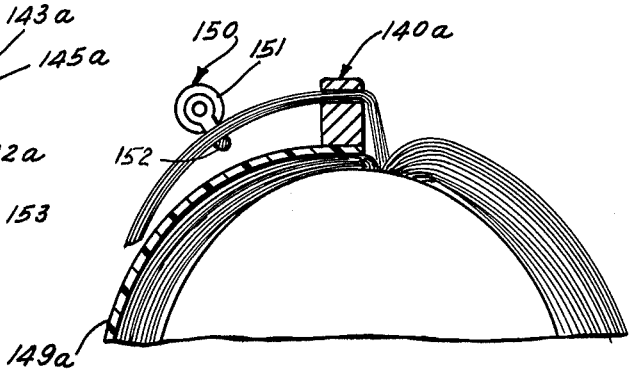
FIG. 4

CLAMP DEVICES FOR USE IN SELECTIVELY ALTERING HAIR COLOR

The present invention is a division of application Ser. No. 592,764, filed July 2, 1975, which is a continuation in part of application Ser. No. 481,695, filed June 25, 1974.

INTRODUCTION

The present invention relates to clamp devices for use in selectively altering hair color. Methods having the purpose of producing hair of variegated colors, preferably in the same color family, by spreading a hair treating liquid onto, and in some cases into, strands or tresses or cubes of hair to produce the different colors or hues and packages for use in such methods form the subject matter of co-pending application Ser. No. 579,012, filed May 19, 1975, entitled "Methods of Selectively Altering Hair Color And Packages For Use Therewith." The clamp devices of the present invention may be used in carrying out some of these and other methods which require means to control the area of the hair to receive the hair coloring liquids. The clamp devices may be used for controlling the application of hair treating liquids to obtain many different variegated effects, including hair bleaching with pasty off-the-scalp type bleaching pastes; milder readily flowable bleach materials that may safely be used against the scalp; hair coloring such as hair tinting and hair toning; hair shading and the like. The word "liquid" as used herein is intended to be broad enough to include any spreadable material even if it will not flow readily because of high viscosity. The devices are adapted for use by nonprofessionals as well as professionals in any and all of these operations, by right-handed and left-handed operators.

DESCRIPTION OF SPECIFIC EMBODIMENTS OF THE INVENTION

Specific embodiments of the invention will be described in conjunction with the drawings in which:

FIGS. 1 and 2 are, respectively, a fragmentary top plan view and a sectional view of a clamp and scalp protector illustrating an embodiment of the invention for enabling the spreading of hair color altering liquids with control of the area that liquids contact; and FIGS. 3 and 4 illustrate a further embodiment of clamp and scalp protecting device similar to that of FIGS. 1 and 2 with which a second clamp or the like may be used to control by physical means the entire area on which hair color altering liquids are spread on the hair;

Referring now to FIGS. 1 and 2, they illustrate a hair treating device comprising a clamp 140 having an elongated holding bar 141 including a plurality of transverse recesses 142 in one surface thereof, each recess being adapted to hold a strand of hair, and a clamping bar pressed against the surface having the recesses with strands of the hair in the recess to hold the clamp to the hair. While such recesses are desirable, good results can be achieved without them. A convenient way for providing the necessary pressure of one bar against the other is by means of a hinge comprising ears 143 at one end of the bar 141 and a cylindrical enlargement 145 at the end of the bar 144 through which a hinge pin 146 is passed to provide a pivotal connection between the bar 141 and the clamping bar 144. At the other end a latch 147 is provided which may be in the form of a resilent extension from one of the bars, e.g., bar 141, at least part way across the other bar which is provided with a recess or notch to receive a latching projection 148 on the latch 147. This latch connection is sufficient to hold the bar 144 tightly against the bar 141 so as to hold the clamp in position on a strand of the hair wherever the operator places it by moving the open clamp transversely off the strand with one hand while the strand is held by the other hand of the operator and then closing and latching the clamp bars tightly against the strand.

FIGS. 3 and 4 illustrate a hair treating device comprising two clamps. One of them bearing reference numerals **141*b* to 147*b* is essentially the same as the bar clamp illustrated in FIGS. 1 and 2. In this embodiment the second clamp 150, which can be of known construction, comprises a hollow bar 151 having an elastic band 152 secured at one end to the bar and with the free end having a fastening means such as a ball or the like thereon which can be slipped into recess 153** in the other end of the bar so as to hold the elastic band tightly against the bar and thereby retain it in position on the hair where an operator places it. Desirably the clamps engage the hair so tightly that seepage of flowable liquids past them is essentially avoided.

The clamps of FIGS. 1 through 4 are especially adapted for use in the process of treating hair which involves the application of hair treating materials to the hair which should not come in contact with the scalp. An example of such a hair treating material is the pasty mixture of BASIC WHITE with a developer which is widely used for lightening hair and is known in the art as an off-the-scalp type bleaching material. The clamps 140 may be placed on strands or tresses of hair adjacent to the scalp to protect the scalp against direct application of the off-the-scalp type bleach material to it. Desirably the scalp is further protected by a sheet 149 or **149*a* of rubber or plastic which is secured to and extends only transversly of the bar 141 or 141*a*, respectively, and may be laid down over the hair as shown in FIGS. 2 and 4**.

It will be understood that when the off-the-scalp type bleach is spread along the strand, it will lie against the protective sheet or shield 149, or **149*a*, and will not get on the scalp to cause irritation or on the underlying hair to provide lightening action where it is not desired. It is thus seen that clamps 141 and 141*a* and the protective shields 149 and 149*a* protect the scalp and the underlying hair from having bleach material applied thereto when the device is in place as shown in FIGS. 2 and 4. If it is desired also to limit the application of the bleach material to new growth only, as is frequently the case, the second clamp 150 is placed on the strands at the end of the new growth so that the bleach material is applied to the strands of hair between the two clamps and is prevented from contacting previously bleached and thereby weakened hair outwardly from the clamp 150** as well as protecting the scalp from contact of the bleaching material as already described.

Having thus described and illustrated the invention, what is claimed is:

1. A device for use in selectively altering hair color comprising a pair of bars hinged together at one end having opposed hair engaging surfaces to receive a strand of hair between them, said bars having aligned bottom surfaces permitting the bars to be placed around a strand of hair close to the scalp, means for removably holding the bars with said surfaces in gripping relation to a strand of hair between them, and a hair protecting shield connected to a bar and extendingly only transversely away from the gripping surface adapted to be positioned between a strand gripped by said bars and surrounding hair underlying said shield whereby said strand of hair may be formed by combing and be held in one hand of a person while the clamp in open position is moved transversely across the strand and then closed upon it.

2. A hair treatment device comprising a clamp having an elongated holding bar and an elongated clamping bar hinged together at one end, said holding bar including a strand of hair and said clamping bar including a strand engaging surface adapted to be removably pressed against the said strand engaging surface of said holding bar to hold the clamp to a strand of hair when it is placed between said bars, the strand engaging surfaces of said bars terminating at aligned bottom surfaces of said bars whereby a clamp is adapted to grip a strand at the scalp, and a resilient latch on the other end of one of said bars extending onto the other end of the other bar, and means including a latching projection and a recess to receive the projection for removably holding said bars in gripping position on a strand of hair.

3. A hair treatment device as set forth in claim 2 in which the strand engaging surface of one of said bars has a plurality of spaced strand recesses therein.

4. A hair treatment device as set forth in claim 2 in which a shield is secured to and extends only transversely from one bar of the clamp in position to underlie a strand of hair held in the clamp and overlie the adjacent hair from which the strand has been separated whereby said strand of hair may be formed by combing and be held in one hand of a person while the clamp in open position is moved transversely across the strand and then closed upon it.

5. A hair treatment device as set forth in claim 2 in which the device comprises two clamps, a first clamp as defined therein and a second clamp adapted to be secured to the hair held in said first clamp at a predetermined distance away from it.

* * * * *